US008102356B2

(12) United States Patent
Kim et al.

(10) Patent No.: US 8,102,356 B2
(45) Date of Patent: Jan. 24, 2012

(54) APPARATUS AND METHOD OF DRIVING FLAT PANEL DISPLAY DEVICE

(75) Inventors: Hong Jae Kim, Gyeonggi-do (KR); June Ho Park, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1017 days.

(21) Appl. No.: 11/812,178

(22) Filed: Jun. 15, 2007

(65) Prior Publication Data

US 2008/0049000 A1 Feb. 28, 2008

(30) Foreign Application Priority Data

Aug. 24, 2006 (KR) ..... 10-2006-0080298
Oct. 25, 2006 (KR) ..... 10-2006-0103858

(51) Int. Cl.
*G09G 3/36* (2006.01)

(52) U.S. Cl. ..... 345/100; 345/211; 349/40

(58) Field of Classification Search ..... None
See application file for complete search history.

(56) References Cited

U.S. PATENT DOCUMENTS 6,937,224 B1 * 8/2005 Miyachi ..... 345/102
2002/0041279 A1 * 4/2002 Chou ..... 345/211

FOREIGN PATENT DOCUMENTS

CN 1845233 * 10/2006

* cited by examiner

*Primary Examiner* — Seokyun Moon
(74) *Attorney, Agent, or Firm* — Morgan, Lewis & Bockius LLP

(57) ABSTRACT

An apparatus and method of driving a flat panel display device is disclosed, to prevent the appearance of afterimages on the flat panel display, the apparatus comprising an image displaying unit which includes a plurality of pixel cells in regions defined by a plurality of gate and data lines on a display panel; and an means formed on the display panel to be connected with the respective gate lines, wherein the means carries out an inspection or discharges electric charges from the image displaying unit when a system power is turned-off, wherein the electric charges are discharged from the image displaying unit by detecting the turning-off point of system power so as to remove the afterimage from the image displaying unit.

5 Claims, 7 Drawing Sheets

APPARATUS AND METHOD OF DRIVING FLAT PANEL DISPLAY DEVICE

This application claims the benefit of Korean Patent Application No. 10-2006-80298 filed on Aug. 24, 2006, and Korean Patent Application No. 10-2006-103858 filed on Oct. 25, 2006, which is hereby incorporated by reference in its entirety.

BACKGROUND OF THE INVENTION

1. Field of the Invention

Embodiments of the present invention relate to a flat panel display device, and more particularly, to an apparatus and method of driving a flat panel display device. Embodiments of the invention are suitable for a wide scope of applications. In particular, embodiments of the invention are suitable for preventing an afterimage on the flat panel display device.

2. Discussion of the Related Art

Recently, various flat panel display devices have been developed to replace cathode ray tube (CRT) displays, which are bulky and heavy. Examples of flat panel display devices include liquid crystal display devices (LCD), field emission displays (FED), plasma display panels (PDP), and light emitting displays (LED).

Among the above-mentioned various flat panel display devices, the LCD device displays moving images using switching element, such as a thin film transistor (TFT). In comparison with the CRT, the LCD device is thinner and lighter than the CRT, and can be applicable to personal computers, notebook computers, office equipment and mobile phones.

When a power is turned-off from the flat panel display device such as the LCD device, afterimages occur for a short period of time. Specifically, electric charges slowly disappear from pixel cells when the power is turned off causing the afterimages to appear on the display panel of the flat panel display device.

SUMMARY OF THE INVENTION

Accordingly, embodiments of the present invention is directed to an apparatus and method of driving a flat panel display device that substantially obviates one or more problems due to limitations and disadvantages of the related art.

An object of embodiments of the present invention is to provide an apparatus and method of driving a flat panel display device that prevents the appearance of afterimages on the flat panel display.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus of driving a flat panel display device comprises an image displaying unit which includes a plurality of pixel cells in regions defined by a plurality of gate and data lines on a display panel; and a means formed on the display panel to be connected with the respective gate lines, wherein the means carries out an inspection or discharges electric charges from the image displaying unit when a system power is turned-off.

In another aspect, an apparatus of driving a flat panel display device comprises an image displaying unit which includes a plurality of pixel cells in regions defined by 'n' gate lines and 'm' data lines on a display panel; a power source detecting unit which generates a power source state signal by detecting a turning-off point of system power; a timing controller which generates an afterimage removing signal on the basis of power source state signal, and controls the image displaying unit so as to display images; and an afterimage removing unit which discharges electric charges from the image displaying unit by at least 'i' horizontal lines with the use of afterimage removing signal.

In another aspect, a method of driving a flat panel display device provided with an image displaying unit having a plurality of pixel cells in regions defined by a plurality of gate and data lines on a display panel comprises a discharging electric charges from the image displaying unit by using an inspecting unit formed on the display panel in connection with the gate lines to carry out an inspection process on an off-state of system power.

In another aspect, a method of driving a flat panel display device provided with an image displaying unit having a plurality of pixel cells in regions defined by 'n' gate lines and 'm' data lines on a display panel comprises a first step of generating a power source state signal by detecting a turning-off point of system power; a second step of generating an afterimage removing signal on the basis of power source state signal; and a third step of discharging electric charges from the image displaying unit by at least 'i' horizontal lines with the use of afterimage removing signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to exemplary embodiments of the present invention, which are illustrated in the accompanying drawings. Wherever possible, the same reference numbers will be used throughout the drawings to refer to the same or like parts.

Figure 1:
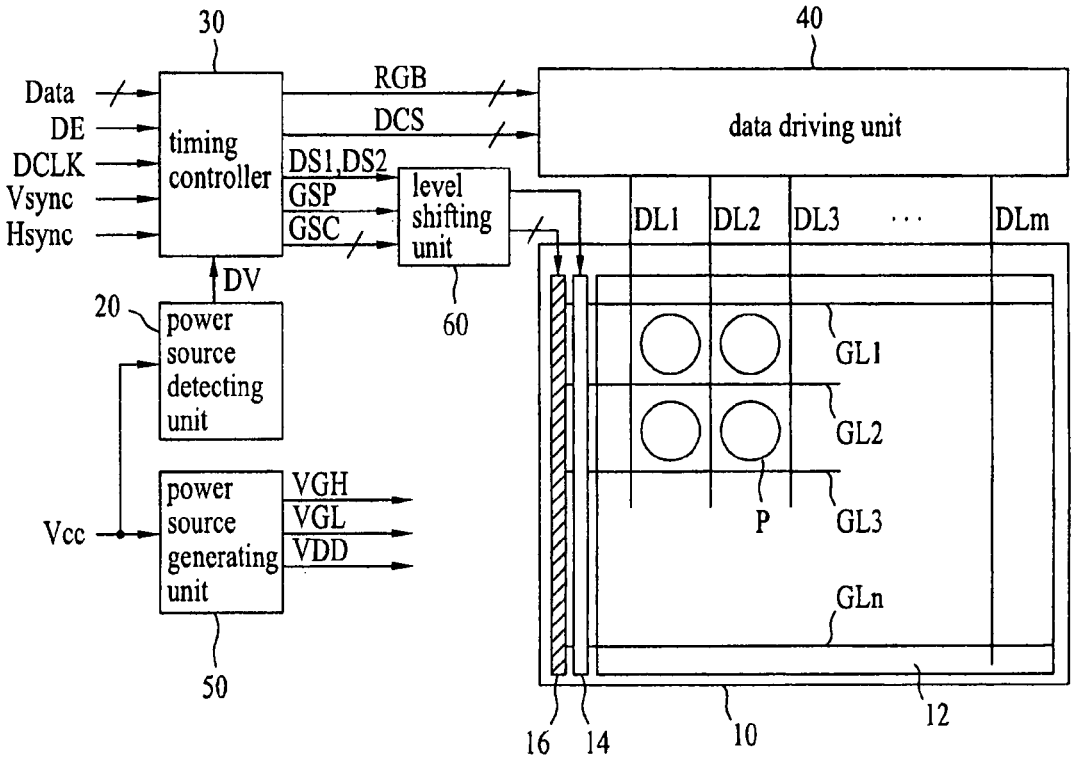
FIG. 1 shows a schematic description of an exemplary flat panel display device according to a first embodiment of the present invention.

FIG. 1 shows a schematic description of an exemplary flat panel display device according to a first embodiment of the present invention. Referring to FIG. 1, the flat panel display device according to the first embodiment includes a display panel 10; an image displaying unit 12 which has a plurality of liquid crystal cells at every region defined by 'n' gate lines (GL) and 'm' data lines (DL) of the display panel 10; and an inspecting unit 14 which carries out an mss production system (MPS) inspection or discharges electric charges from the image displaying unit 12 when a system power is turned-off, wherein the inspecting unit 14 is formed on the display panel 10 and is electrically connected with each gate line (GL).

Also, the flat panel display device according to the first embodiment includes a power source detecting unit 20 which generates a power source state signal (DV) by detecting a turning-off point (OFF) of system power (Vcc); a data driving unit 40 which supplies video signals to the data lines (DL); a gate driving unit 16 which sequentially supplies scan signals to the gate lines (GL); a timing controller 30 which supplies externally input data (Data) to the data driving unit 40, generates first and second afterimage removing signals (DS1, DS2) to discharge electric charges from the image displaying unit 12 on the basis of power source state signal (DV), and also generates control signals (DCS, GSP, GSC) to control the gate and data driving units 16 and 40; a power source generating unit 50 which generates voltages (VGH, VGL, VDD) for driving the flat panel display device by the system power (Vcc); and a level shifting unit 60 which raises the voltage level of gate control signals (GSP, GSC) and supplies them to the gate driving unit 16, and also raises the voltage level of first and second afterimage removing signals (DS1, DS2) and supplies them to the inspecting unit 14.

The image displaying unit 12 includes a plurality of thin film transistors (TFT) in regions defined by crossings of the 'n' gate lines (GL1 to GLn) with the 'm' data lines (DL1 to DLm); and a plurality of pixel cells (P) connected to the thin film transistors (TFT) respectively. Each of the thin film transistors (TFT) supplies the video signal supplied from the data line (DL) to the pixel cell (P) on the basis of scan signal supplied to the gate line (GL). At this time, the pixel cell (P) may be displayed as a liquid crystal cell which is equivalently represented as a liquid crystal capacitor, or may be displayed as a light-emitting cell which is equivalently represented as a light-emitting diode. The pixel cell (P) includes a storage capacitor to maintain the video signal supplied through the thin film transistor until the next video signal is supplied.

The power source generating unit 50 generates the gate high voltage and gate low voltage (VGH, VGL) and the driving voltage (VDD) for driving the image displaying unit 12, the timing controller 30, the gate and data driving units 16 and 40, and the power source detecting unit 20 by using the system power (Vcc).

The power source detecting unit 20 detects the turning-off point of system power (Vcc) by detecting the voltage level of system power (Vcc) supplied from the external, thereby generating the power source state signal (DV). That is, if the voltage level of system power (Vcc) is higher than a preset voltage level, for example, the voltage level is in the power-on state, the power source detecting unit 20 generates a high level power source state signal (DV). If the voltage level of system power (Vcc) is lower than a preset voltage level, for example, the voltage level is in the power-off state, the power source detecting unit 20 generates a low level power source state signal (DV).

The timing controller 30 aligns input data (Data); supplies the aligned data (RGB) to the data driving unit 40; and generates control signals (DCS, GSP, GSC) to control the gate and data driving units 16 and 40, and generates the first and second afterimage removing signal (DS1, DS2) on the basis of the power source state signal (DV) supplied from the power source detecting unit 20.

Figure 2:
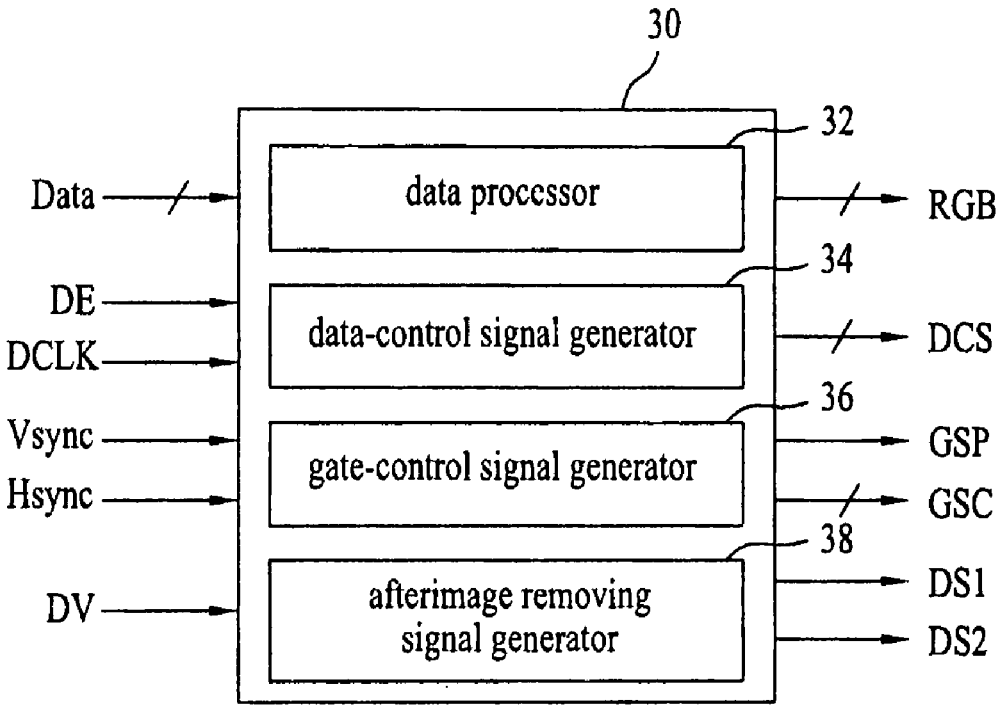
FIG. 2 shows a block diagram description of an exemplary timing controller according to a first embodiment of the invention.

FIG. 2 shows a block diagram description of an exemplary timing controller according to a first embodiment of the invention. Referring to FIG. 2, the timing controller 30 includes a data processor 32, a data-control signal generator 34, a gate-control signal generator 36, and an afterimage removing signal generator 38. The data processor 32 aligns the input data (Data) to be suitable for driving the image displaying unit 12, and supplies the aligned data to the data driving unit 40. Then, the data-control signal generator 34 generates a data control signal (DCS) to control the data driving unit 40 by using at least one of a data enable signal (DE), a dot clock (DCLK), and horizontally and vertically synchronized signals (Hsync, Vsync); and supplies the generated data control signal (DCS) to the data driving unit 40. In this case, the data control signal (DCS) includes a source output enable (SOE), a source shift clock (SSC), and a source start pulse (SSP).

The gate-control signal generator 36 generates a gate start pulse (GSP) and a plurality of gate shift clocks (GSC) by using at least one of the data enable signal (DE), the dot clock (DCLK), and the horizontally and vertically synchronized signals (Hsync, Vsync), wherein the plurality of gate shift clocks (GSC) are provided with phases delayed in sequence. Then, the gate-control signal generator 36 supplies the generated gate start pulse (GSP) and gate shift clocks (GSC) to the level shifting unit 60. At this time, gate-control signal generator 36 generates the gate start pulse (GSP) every frame unit, and generates at least two gate shift clocks (GSC) on the basis of driving conditions of gate driving unit 16.

The afterimage removing signal generator 38 generates the first and second afterimage removing signals (DS1, DS2) on the basis of the low level value of the power source state signal (DV) supplied from the power source detecting unit 20. At this time, the afterimage removing signal generator 38 generates the first and second afterimage removing signals (DS1, DS2) having the same voltage level by inverting the logic state of power source state signal (DV). In the meantime, the afterimage removing signal generator 38 may generate the first and second afterimage removing signals (DS1, DS2) having the inverted types from each other by inverting the logic state of power source state signal (DV).

In FIG. 1, the data driving unit 40 converts the video signal (RGB) supplied from the timing controller 30 into the analog video signal on the basis of data control signal (DCS) supplied from the timing controller 30; and supplies the analog video signal for one horizontal line to the data line (DL) by each horizontal period to provide the scan signal to the gate line (GL). At this time, the data driving unit 40 may be connected to the display panel 10 by tape carrier package (TCP) or chip on film (COF), or may be mounted on the display panel 10 by chip on glass (COG).

The level shifting unit 60 includes a plurality of level shifters for raising the respective voltage levels of the first and second afterimage removing signals (DS1, DS2), and the gate start pulse (GSP) and the plurality of gate shift clocks (GSC) supplied from the timing controller 30.

In detail, the level shifting unit 60 raises the voltage level of plurality of gate shift clocks (GSC) by using the gate high voltage (VGH) and gate low voltage (VGL) supplied from the power source generating unit 50, and supplies the plurality of gate shift clocks (GSC) having the raised voltage level to the gate driving unit 16. Also, the level shifting unit 60 raises the voltage level of first and second afterimage removing signals (DS1, DS2), and supplies the first and second afterimage removing signals (DS1, DS2) having the raised voltage level to the inspecting unit 14. Furthermore, the level shifting unit 60 raises the voltage level of gate start pulse (GSP) by using the driving voltage (VDD) supplied from the power source generating unit 50, and supplies the gate start pulse (GSP) having the raised voltage level to the gate driving unit 16.

In the meantime, the timing controller 30 may directly supply the gate start pulse (GSP) to the gate driving unit 16, and may directly supply the first and second afterimage removing signals (DS1, DS2) to the inspecting unit 14.

The gate driving unit 16 is formed at one side of the display panel 10 such that the gate driving unit 16 is connected to the 'n' gate lines (GL) respectively. At this time, the gate driving unit 16 is formed in the fabrication process of thin film transistor of image displaying unit 12. As the gate driving unit 16 is operated by the gate start pulse (GSP), the gate driving unit 16 shifts the phases of gate shift clocks (GSC), and supplies the scan signals having the voltage level of gate high voltage (VGH) to the gate lines (GL) in sequence. In response to the scan signal, the thin film transistor (TFT) is turned-on.

The inspecting unit 14 is formed in the display panel 10 between the image displaying unit 12 and the gate driving unit 16 such that the inspecting unit 14 is connected to the 'n' gate lines (GL) respectively. On the off-state of system power, the electric charges are discharged from the image displaying unit 12 by the inspecting unit 14.

Figure 3:
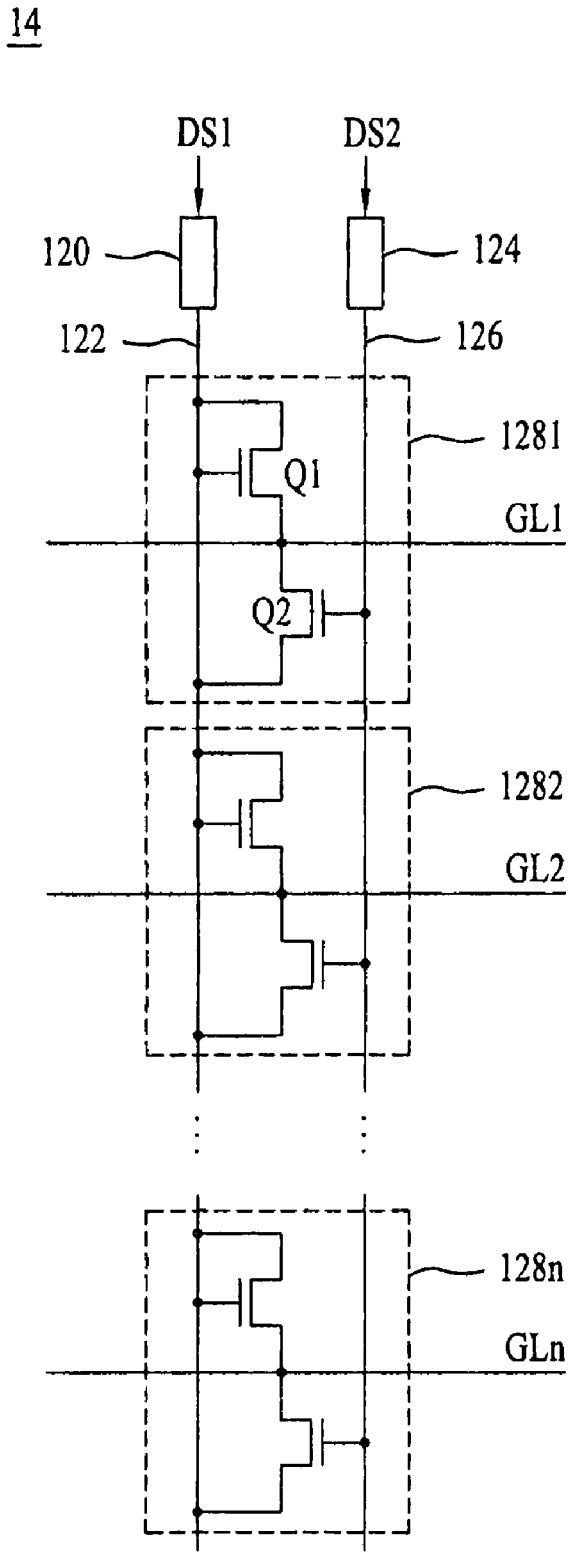
FIG. 3 shows a schematic description of an exemplary inspecting unit according to a first embodiment of the invention.

For this, as shown in FIG. 3, the inspecting unit 14 includes a first signal line 122 connected with a first input pad 120; a second signal line 126 connected with a second input pad 124; and 'n' switching circuits 1281 to 128*n* to turn on the thin film transistors respectively connected with the gate lines (GL) on the off-state of system power (Vcc) according to the voltage supplied from the first and second signal lines 122 and 126.

The first input pad 120 is supplied with the first afterimage removing signal (DS1) of low state according to the power source state signal (DV) of high state on the on-state of power system (Vcc), and is also supplied with the first afterimage removing signal (DS1) of high state according to the power source state signal (DV) of low state on the off-state of system power (Vcc). Also, the first input pad 120 is supplied with a first inspection signal supplied from an inspection signal generator (not shown) on the inspection process.

The second input pad 124 is supplied with the second afterimage removing signal (DS2) of low state according to the power source state signal (DV) of high state on the on-state of system power (Vcc), and is also supplied with the second afterimage removing signal (DS2) which is identical to or different from the first afterimage removing signal (DS1) according to the power source state signal (DV) of system power (Vcc) on the off-state of system power (Vcc). Also, the second input pad 124 is supplied with a second inspection signal supplied from the inspection signal generator on the inspection process, wherein the second inspection signal is different from the first inspection signal. In this case, the second inspection signal is formed in an inverted type of the first inspection signal.

Each of the 'n' switching circuits 1281 to 128*n* includes a first transistor (Q1) which is turned-on by the first afterimage removing signal (DS1) of high state supplied to the first signal line 122, and supplies the first afterimage removing signal (DS1) of high state to the gate line (GL); and a second transistor (Q2) which is turned-on by the second afterimage removing signal (DS2) of high state supplied to the second signal line 126, and supplies the first afterimage removing signal (DS1) supplied to the first signal line 122 to the gate line (GL).

The first transistor (Q1) includes gate and source electrodes connected to the first signal line 122 by the diode type, and a drain electrode connected to the gate line (GL). The first transistor (Q1) is turned-on by the first afterimage removing signal (DS1) of high state, so that the first afterimage removing signal (DS1) of high state is supplied to the gate line (GL). Thus, the thin film transistors connected to the corresponding gate line are turned-on at the same time.

The second transistor (Q2) includes a gate electrode connected to the second signal line 126; a source electrode connected to the first signal line 122; and a drain electrode connected to the gate line (GL). The second transistor (Q2) is turned-on by the second afterimage removing signal (DS2) of high state, so that the first afterimage removing signal (Ds1) of low state supplied from the first signal line 122 is supplied to the gate line (GL). Thus, the thin film transistors connected to the corresponding gate line are turned-on at the same time.

An operation of the inspecting unit 14 on the off-state of system power (Vcc) will be explained as follows.

First, if generating the first and second afterimage removing signals (DS1, DS2) having the same voltage level in the timing controller 30 according to the power source state signal (DV) corresponding to the turning-off point of system power (Vcc), the first input pad 120 of inspecting unit 14 is supplied with the first afterimage removing signal (DS1) of high state, and the second input pad 124 of inspecting unit 14 is supplied with the second afterimage removing signal (DS2) of high state simultaneously.

According as the first transistor (Q1) is turned-on by the first and second afterimage removing signals (DS1, DS2) of high state supplied to the first and second input pads 120 and 124 on the off-state of system power (Vcc), each of the switching circuits 1281 to 128*n* of inspecting unit 14 supplies the first afterimage removing signal (DS1) of high state to each gate line (GL). At this time, the second transistor (Q2) of each of the switching circuits 1281 to 128*n* is provided with the gate and source electrodes having the same voltage level, so that the second transistor (Q2) is maintained as the off-state. As the switching circuits 1281 to 128*n* turn on the thin film transistors connected to the respective gate lines simultaneously, the afterimage generated on the off-state of system power is removed from the image displaying unit 12 by discharging the electric charges from the image displaying unit 12.

If generating the first and second afterimage removing signals (DS1, DS2) having the different voltage levels in the timing controller 30 according to the power source state signal (DV) corresponding to the turning-off point of system power (Vcc), the first input pad 120 of inspecting unit 14 is supplied with the first afterimage removing signal (DS1) of high state, and the second input pad 124 of inspecting unit 14 is supplied with the second afterimage removing signal (DS2) of low state simultaneously.

According as the first transistor (Q1) is turned-on by the first afterimage removing signal (DS1) of high state supplied to the first input pads 120 on the off-state of system power (Vcc), each of the switching circuits 1281 to 128*n* supplies the first afterimage removing signal (DS1) of high state to each gate line (GL). At this time, the second transistor (Q2) of each of the switching circuits 1281 to 128*n* is maintained as the off-state by the second afterimage removing signal (DS2) of low state. As the switching circuits 1281 to 128*n* turn on the thin film transistors connected to the respective gate lines simultaneously, the afterimage generated on the off-state of system power is removed from the image displaying unit 12 by discharging the electric charges from the image displaying unit 12.

Then, the first input pad 120 of inspecting unit 14 is supplied with the first afterimage removing signal (DS1) of low state, and the second input pad 124 is supplied with the second afterimage removing signal (DS2) of high state at the same time. According as the second transistor (Q2) is turned-on by the second afterimage removing signal (DS2) of high state, the switching circuits 1281 to 128*n* supply the first afterimage removing signal (DS1) of low state supplied to the first signal line 122 to each gate line. As a result, each of the switching circuits 1281 to 128*n* turns off the thin film transistors connected with the respective gate lines at the same time.

Figure 4:
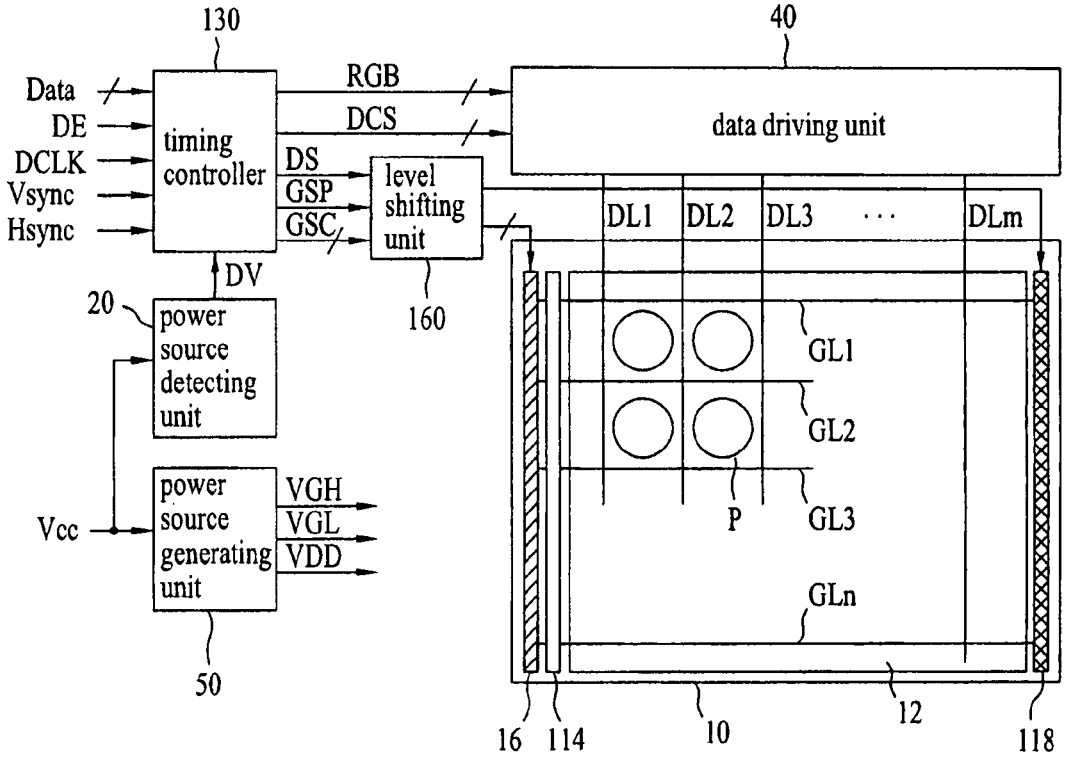
FIG. 4 shows a schematic description of an exemplary flat panel display device according to a second embodiment of the present invention.

FIG. 4 shows a schematic description of an exemplary flat panel display device according to a second embodiment of the present invention. Referring to FIG. 4, the flat panel display device includes a display panel 10; an image displaying unit 12 which has a plurality of liquid crystal cells at every region defined by 'n' gate lines (GL) and 'm' data lines (DL) of the display panel 10; a power source detecting unit 20 which generates a power source state signal (DV) by detecting a turning-off point (Off) of system power (Vcc); a timing controller 130 which generates an afterimage removing signal (DS) on the basis of power source state signal (DV) outputted from the power source detecting unit 20, and also controls the image displaying unit 12 so as to display images; and an afterimage removing unit 118 which removes the afterimages from the image displaying unit 12 by discharging electric charges of the image displaying unit 12 by at least 'i' horizontal lines with the use of afterimage removing signal (DS).

Also, the flat panel display device includes a data driving unit 40 which supplies video signals to the data lines (DL) under control of the timing controller 130; a gate driving unit 16 which sequentially supplies scan signals to the gate lines (GL) under control of the timing controller 130; a power source generating unit 50 which generates voltages (VGH, VGL, VDD) for driving the flat panel display device by the system power (Vcc); and a level shifting unit 160 which raises the voltage level of afterimage removing signal (DS) outputted from the timing controller 130, and supplies the raised voltage to the afterimage removing unit 118.

The image displaying unit 12, the gate driving unit 16, the power source detecting unit 20 and the data driving unit 40 in the flat panel display device according to the second embodiment are identical in structure to those of first embodiment.

The timing controller 130 aligns input data (Data); supplies the aligned data (RGB) to the data driving unit 40; and generates control signals (DCS, GSP, GSC) to control the gate and data driving units 16 and 40, and generates the afterimage removing signal (DS) on the basis of the power source state signal (DV) supplied from the power source detecting unit 20.

Figure 5:
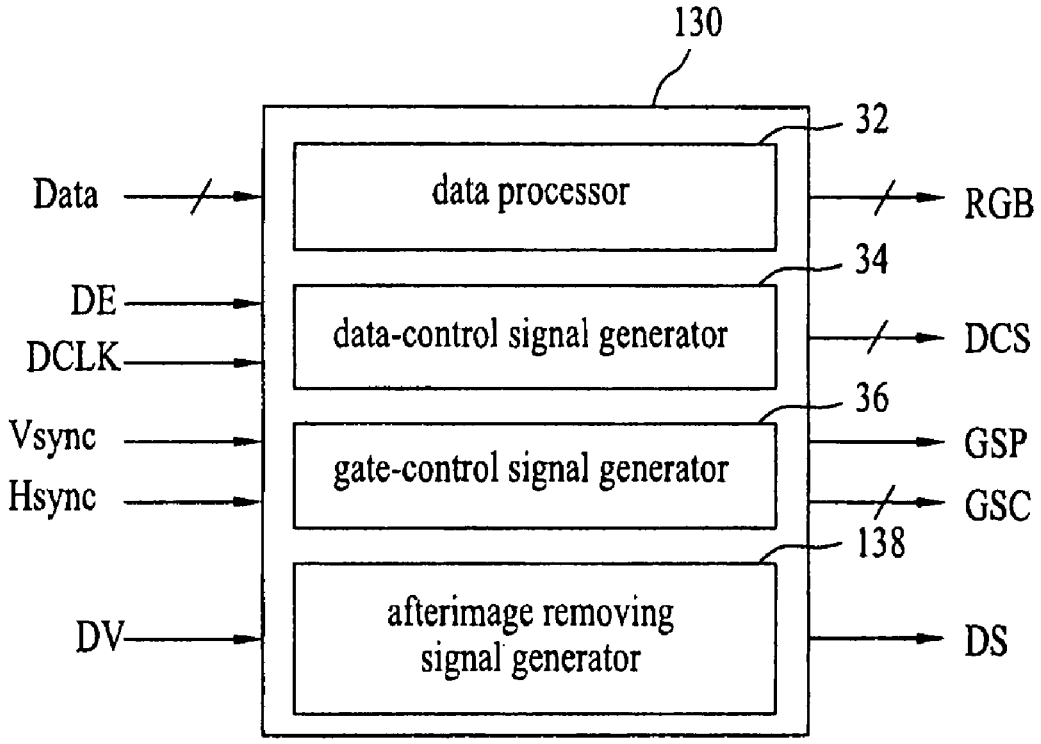
FIG. 5 shows a block diagram description of an exemplary timing controller according to a second embodiment of the invention.

FIG. 5 shows a block diagram description of an exemplary timing controller according to a second embodiment of the invention. Referring to FIG. 5, the timing controller 130 includes a data processor 32, a data-control signal generator 34, a gate-control signal generator 36, and an afterimage removing signal generator 138. At this time, the data processor 32, the data-control signal generator 34, the gate-control signal generator 36 are identical in structure to those of the first embodiment shown in FIG. 2.

The afterimage removing signal generator 138 generates the afterimage removing signal (DS) on the basis of the low level value of the power source state signal (DV) supplied from the power source detecting unit 20. For example, the afterimage removing signal generator 138 may be an inverter that inverts the logic state of power source state signal (DV).

In FIG. 4, the level shifting unit 160 includes a plurality of level shifters for raising the respective voltage levels of the gate start pulse (GSP) and the plurality of gate shift clocks (GSC) supplied from the gate-control signal generator 36, and the afterimage removing signal (DS) supplied from the afterimage removing signal generator 138. That is, the level shifting unit 160 raises the voltage level of plurality of gate shift clocks (GSC) and the afterimage removing signal (DS) by using the gate high voltage (VGH) and gate low voltage (VGL) supplied from the power source generating unit 50; and supplies the plurality of gate shift clocks (GSC) having the raised voltage level to the gate driving unit 16 and supplies the afterimage removing signal (DS) having the raised voltage level to the afterimage removing unit 118. Also, the level shifting unit 160 raises the voltage level of gate start pulse (GSP) by using the driving voltage (VDD) supplied from the power source generating unit 50; and supplies the gate start pulse (GSP) having the raised voltage level to the gate driving unit 16.

In the meantime, the timing controller 130 may directly supply the gate start pulse (GSP) to the gate driving unit 16, and may directly supply the afterimage removing signal (DS) to the afterimage removing unit 118.

The afterimage removing unit 118 is formed within the display panel 10 to be connected to the 'n' gate lines (GL). In consideration of the load, the afterimage removing unit 118 discharges the electric charges from each pixel cell (P) by 'i' horizontal lines ('i' is n/2) with the use of afterimage removing signal (DS) on the off-state of system power (Vcc).

Figure 6:
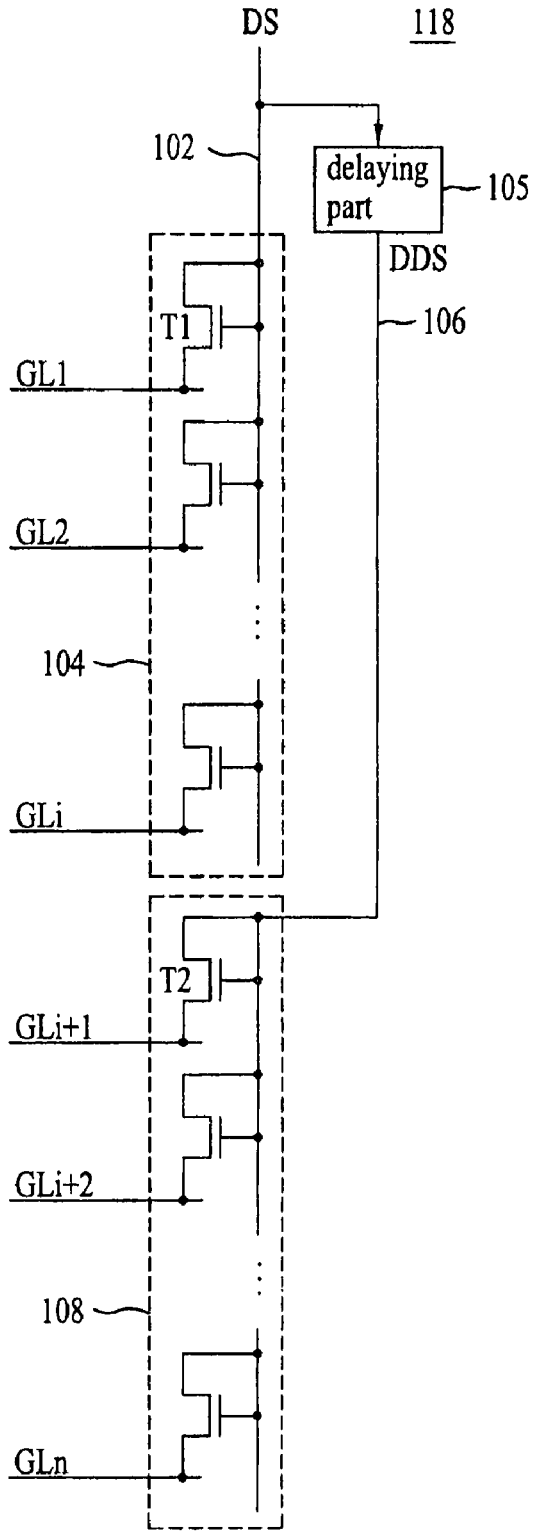
FIG. 6 shows a schematic description of an exemplary afterimage removing unit according to a second embodiment of the invention.

FIG. 6 shows a schematic description of an exemplary afterimage removing unit according to a second embodiment of the invention. Referring to FIG. 6, the afterimage removing unit 118 includes a first input line 102 to which the afterimage removing signal (DS) is supplied; a delaying part 105 which delays the afterimage removing signal (DS) by a preset time period; a second input line 106 to which the delayed afterimage removing signal (DDS) outputted from the delaying part 105 is supplied; a first afterimage removing circuit 104 which supplies the afterimage removing signal (DS) outputted from the first input line 102 to the first to (i)-th gate lines (GL1 to GLi) respectively; and a second afterimage removing circuit 108 which supplies the delayed afterimage removing signal (DDS) outputted from the second input line 106 to the (i+1)-th to (n)-th gate lines (GLi+1 to GLn) respectively.

The first afterimage removing circuit 104 includes 'i'-numbered first transistors (T1) which are respectively connected to the first to (i)-th gate lines (GL1 to GLi) and are also connected to the first input line 102 by the diode type. At this time, each of the first transistors (T1) is comprised of source and gate electrodes connected to the first input line 102, and a drain electrode connected to the gate line. According as the first transistor (T1) is turned-on by the afterimage removing signal (DS) of high state supplied from the first input line 102, the first transistor (T1) supplies the afterimage removing signal (DS) of high state supplied from the first input line 102 to the corresponding gate line.

Accordingly, the first afterimage removing circuit 104 turns on the thin film transistors respectively connected to the first to (i)-th gate lines (GL1 to GLi) on the basis of afterimage removing signal (DS) of high state supplied from the first input line 102 at the same time, whereby the electric charges are discharged from the pixel cells (P) of the first to (i)-th horizontal lines.

The delaying part 105 delays the afterimage removing signal (DS) supplied from the first input line 102 by the predetermined time, and supplies the delayed afterimage removing signal (DDS) to the second input line 106. For this, the delaying part 105 may be formed of a resistor or a diode-type transistor.

The second afterimage removing circuit 108 includes 'i'-numbered second transistors (T2) which are respectively connected to the (i+1)-th to (n)-th gate lines (GLi+1 to GLn) and are also connected to the second input line 102 by the diode type. At this time, each of the second transistors (T2) is comprised of source and gate electrodes connected to the second input line 106, and a drain electrode connected to the gate line. According as the second transistor (T2) is turned-on by the delayed afterimage removing signal (DS) of high state supplied from the second input line 106, the second transistor (T2) supplies the delayed afterimage removing signal (DS) of high state supplied from the second input line 106 to the corresponding gate line.

Accordingly, the second afterimage removing circuit 108 turns on the thin film transistors respectively connected to the (i+1)-th to (n)-th gate lines (GLi+1 to GLn) on the basis of delayed afterimage removing signal (DDS) of high state supplied from the second input line 106 at the same time, whereby the electric charges are discharged from the pixel cells (P) of the (i+1)-th to (n)-th horizontal lines.

The flat panel display device according to the second embodiment may additionally include an inspecting unit 114 which is formed between the image displaying unit 12 and the gate driving unit 16 on the display panel 10.

Figure 7:
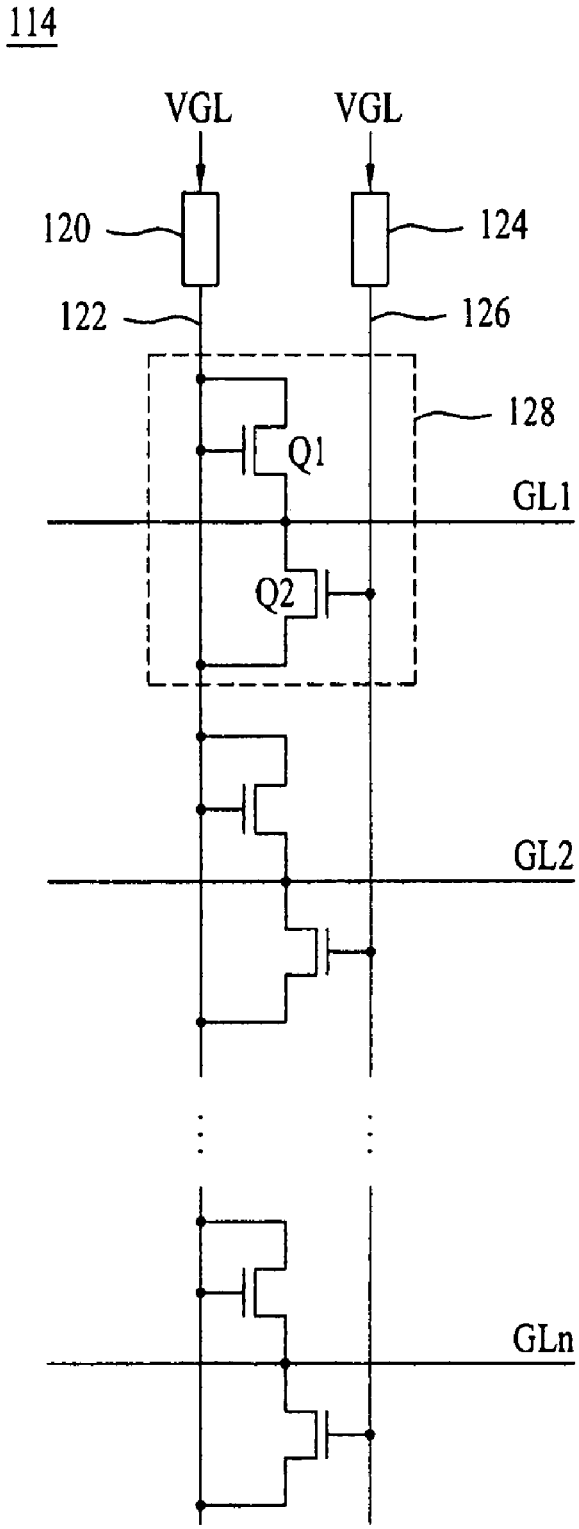
FIG. 7 shows a schematic description of an exemplary inspecting unit according to a second embodiment of the invention.

As shown in FIG. 7, the inspecting unit 114 is comprised of a first inspection line 122 connected to a first inspection pad 120; a second inspection line 126 connected to a second inspection pad 124; and 'n' inspection circuits 128 to supply inspection signals to the respective gate lines according to the inspection signals supplied from the first and second inspection lines 122 and 126.

This inspecting unit 114 of the second embodiment is identical in structure to that of the first embodiment shown in FIG. 3.

The inspecting unit 114 is used on the inspection process for each gate line. After completing the inspection process, the inspecting unit 114 is supplied with the gate low voltage (VGL) supplied from the external. Accordingly, the 'n' inspection circuits 128 included in the inspecting unit 114 are not operated when the flat panel display device is in the normal-operation state.

In the meantime, the above-mentioned afterimage removing unit 118 divides the 'n' gate lines (GL) into lower and upper parts, and then discharges the electric charges from the pixel cells (P) of each part sequentially. However, the electric charges may be discharged from the pixel cells (P) by dividing the 'n' gate lines (GL) into three or more parts.

As mentioned above, the apparatus and method of driving the flat panel display device according to the present invention has the following advantages.

In the apparatus and method of driving the flat panel display device according to the present invention, the electric charges are discharged from the image displaying unit by at least 'i' horizontal lines by detecting the turning-off point of system power, so that it is possible to remove the afterimage from the image displaying unit.

It will be apparent to those skilled in the art that various modifications and variations can be made in the embodiments of the present invention without departing from the spirit or scope of the invention. Thus, it is intended that the present invention covers the modifications and variations of the embodiments provided they come within the scope of the appended claims and their equivalents.

What is claimed is:

1. An apparatus of driving a flat panel display device comprising:

an image displaying unit which includes a plurality of pixel cells in regions defined by a plurality of gate and data lines on a display panel; and a means formed on the display panel to be connected with the respective gate lines, wherein the means carries out an inspection or discharges electric charges from the image displaying unit when a system power is turned-off;

a power source detecting unit which generates a power source state signal by detecting a turning-off point of system power;

a data driving unit which supplies video signals to the data lines;

a gate driving unit which sequentially supplies scan signals to the gate lines;

a timing controller which supplies input data to the data driving unit, generates control signals to control the gate and data driving units, and generates first and second afterimage removing signals to discharge electric charges from the image displaying unit according to the power source state signal; and a power source generating unit which generates voltages for driving the flat panel display device by using the system power;

wherein the timing controller comprises:

1) a data processor which aligns input data, and supplies the aligned data to the data driving unit;

2) a data-control signal generator which generates a data control signal to control the data driving unit;

3) a gate-control signal generator which generates gate control signals including a gate start pulse and a plurality of gate shift clocks to control the gate driving unit; and 4) an afterimage removing signal generator which generates the first and second afterimage removing signals on the basis of power source state signal;

wherein the afterimage removing signal generator generates the first and second afterimage removing signals which have different voltage levels by inverting the power source state signal;

wherein the first afterimage removing signal is in a high state when the second afterimage removing signal is in a low state;

wherein the first afterimage removing signal is in a low state when the second afterimage removing signal is in a high state;

wherein the means comprises:

1) a first signal line supplied with the first afterimage removing signal;

2) a second signal line supplied with the second afterimage removing signal; and 3) a plurality of switching circuits connected with the respective gate lines so as to turn on thin film transistors connected with the gate lines according to the first and second afterimage removing signals supplied to the first and second signal lines at the same time;

wherein each of the switching circuits comprises:

1) a first transistor which is connected with the first signal line in a diode type to supply the first afterimage removing signal to the gate line according to the first afterimage removing signal; and 2) a second transistor which supplies the first afterimage removing signal supplied to the first signal line to the gate line according to the second afterimage removing signal supplied to the second signal line, wherein the first and the second transistors are turned on at different timings.

2. The apparatus of claim 1, further comprising a level shifting unit which raises the voltage level of gate control signal, and supplies the gate control signal having the raised voltage level to the gate driving unit; and raises the voltage level of first and second afterimage removing signals, and supplies the first and second afterimage removing signals having the raised voltage level to the means.

3. The apparatus of claim 1, wherein the gate driving unit is directly formed on the display panel to be connected to the respective gate lines.

4. A method of driving a flat panel display device provided with an image displaying unit having a plurality of pixel cells in regions defined by a plurality of gate and data lines on a display panel comprising:

discharging electric charges from the image displaying unit by using an inspecting unit formed on the display panel in connection with the gate lines to carry out an inspection process on an off-state of system power;

generating a power source state signal by detecting a turning-off point of system power;

generating voltages to drive the flat panel display device by using the system power; and generating first and second afterimage removing signals by inverting the power source state signal to discharge electric charges from the image displaying unit, wherein the first signal line supplied with the first afterimage removing signal, and the second line supplied with the second afterimage removing signal;

wherein the first and second afterimage removing signals have different voltage levels;

wherein the first afterimage removing signal is in a high state when the second afterimage removing signal is in a low state;

wherein the first afterimage removing signal is in a low state when the second afterimage removing signal is in a high state;

wherein discharging the electric charges from the image displaying unit using the inspecting unit comprises:

1) turning on thin film transistors connected to the respective gate lines at the same time by using the first and second transistors, wherein the first transistor is connected with the first signal line in a diode type to supply the first afterimage removing signal to the gate line according to the first afterimage removing signal, wherein the second transistor supplies the first afterimage removing signal supplied to the first signal line to the gate line according to the second afterimage removing signal supplied to the second signal line, and wherein the first afterimage removing signal is in the high and the second afterimage removing signal is in the low state; and 2) turning off the thin film transistors by using the first and second transistors, wherein the first transistor is connected with the first signal line in a diode type to supply the first afterimage removing signal to the gate line according to the first afterimage removing signal, wherein the second transistor supplies the first afterimage removing signal supplied to the first signal line to the gate line according to the second afterimage removing signal supplied to the second signal line, and wherein the first afterimage signal is in the low state and, wherein the first afterimage removing signal is in the low state and the second afterimage removing signal is in the high state, and wherein the first and the second transistors are turned on at different timings.

5. The method of claim 4, further comprising supplying the first and second afterimage removing signals having the raised level to the means by using the driving voltages.

* * * * *